United States Patent [19]

Madden, III

[11] Patent Number: 4,958,388

[45] Date of Patent: Sep. 25, 1990

[54] SOCKS WITH SIZE INDICATING STRIPES

[75] Inventor: James J. Madden, III, Loudonville, N.Y.

[73] Assignee: Ballston Knitting Company, Inc., Ballston Spa, N.Y.

[21] Appl. No.: 353,034

[22] Filed: May 17, 1989

[51] Int. Cl.[5] ..... A41B 11/00

[52] U.S. Cl. ..... 2/239; 2/240

[58] Field of Search ..... 2/239, 240, 241, 242; D2/329

[56] References Cited

U.S. PATENT DOCUMENTS

| | | | |
|---|---|---|---|
| D. 287,366 | 12/1986 | Hagen | D2/329 |
| 2,087,572 | 7/1937 | Gastrich | 66/178 |
| 2,569,434 | 9/1951 | Ischinger | 66/178 |
| 2,621,501 | 12/1952 | Jenkins | 2/239 |
| 3,039,282 | 6/1962 | Hayes | 66/178 |
| 3,324,686 | 6/1967 | Rosenstein | 66/187 |
| 4,104,892 | 8/1978 | Thorneburg | 2/239 |
| 4,734,938 | 4/1988 | Anderson | 2/239 |

OTHER PUBLICATIONS

Hanes Advertisement, *Hosiery & Underwear,* Back Cover, Jan. 1976 issue.

*Primary Examiner*—Werner H. Schroeder
*Assistant Examiner*—G. Hale
*Attorney, Agent, or Firm*—Bell, Seltzer, Park & Gibson

[57] ABSTRACT

A selected number of size indicating stripes is formed in a particular location in the socks, such as the cuff. The number of size indicating stripes is selected to indicate the size of the particular sock in which the size indicating stripes are knit so that the size of the particular sock is easily recognizable by the number of size indicating stripes knit therein. The size indicating stripes extend completely around the sock and are knit with circular courses of a particular color of yarn, which color contrasts with the color of the yarn knit in the adjacent areas of the sock.

5 Claims, 1 Drawing Sheet

SOCKS WITH SIZE INDICATING STRIPES

FIELD OF THE INVENTION

This invention relates generally to socks with size indicating stripes knit of a yarn contrasting in color with the overall color of the socks, and more particularly to such socks in which one or more size indicating stripes are knit in the cuff portion so that the particular size of the sock is easily recognizable by the number of the size indicating stripes in the cuff of the socks.

BACKGROUND OF THE INVENTION

U.S. Pat. No. 2,621,501 is directed to a permanent size indicia for clothes, such as socks, in which circular areas are knit in the heels of the socks. The circular areas are knit with yarns which are different in color from the color of the yarn knit throughout the remainder of the sock. The yarns used in knitting the circular areas in the heels of the socks may be either yellow, blue or red and indicate the particular size of the sock on which one of these colored circles appear. The knit circles of different colors of yarn are also helpful in pairing socks after laundering. However, it is difficult to knit circular areas of different colored yarns in the heel portion of socks, without requiring extensive modification of the knitting machine on which the socks are knit. Also, the formation of circular size indicating areas in the heels of socks may not be readily visible when the socks are folded for storage.

SUMMARY OF THE INVENTION

With the foregoing in mind, it is an object of the present invention to provide socks with a selected number of size indicating stripes in a selected portion of the socks, which stripes can be easily knit on conventional circular knitting machines by conventional patterning mechanisms, without requiring any modification of the circular knitting machine.

The socks of the present invention include integrally knit cuff, leg and foot portions and the socks are knit in a variety of sizes. The socks are knit substantially throughout with circular courses of a particular color of yarn and include one or more size indicating stripes extending completely around and in a particular location in one of the sock portions, such as the cuff. The size indicating stripes are knit in a plurality of the circular courses with a yarn contrasting in color with the particular color of the yarn knit throughout substantially the entire sock. The number of size indicating stripes of contrasting color yarn is selected to indicate the size of the sock in which the size indicating stripes are knit so that the size of a particular sock is easily recognizable by the number of size indicating stripes knit in the cuff of the sock. Each of the size indicating stripes are preferably four courses wide. Where multiple size indicating stripes are employed, the size indicating stripes are separated by four adjacent courses knit of the same color of yarn as the body of the sock.

Socks are usually displayed for sale in a store with the cuffs clearly visible. Thus, the prospective customer can easily recognize the socks which are of the required size, by noting the number of size indicating stripes knit in the cuffs of all of the socks displayed. The socks of the present invention with size indicating stripes in the cuff are a great aid to the prospective customer when selecting socks of the required size.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
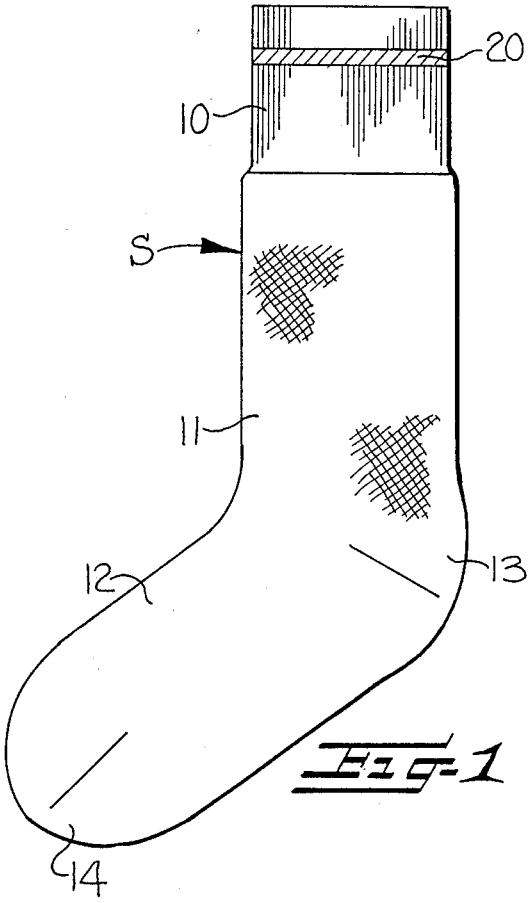
FIG. 1 is a side elevational view of a particular size of sock and provided with a single size indicating stripe in the cuff portion thereof.

As illustrated in FIG. 1, the sock, broadly indicated at S, includes integrally knit cuff portion 10, leg portion 11, and foot portion 12. The cuff portion 10 is knit in a conventional manner and is usually provided with an elastic yarn to form a mock rib construction. The foot portion 12 includes the usual heel pocket 13 and toe pocket 14. The sock S is knit in a variety of sizes by varying the size of stitch loops knit and/or the number of courses knit in the leg and foot portions of the sock. The sock S is usually knit substantially throughout with circular courses of a particular color of yarn. The leg and foot portions 11, 12 may be knit of the same color of yarn, or these portions may be provided with various patterns, involving yarns of different colors.

Figure 2:
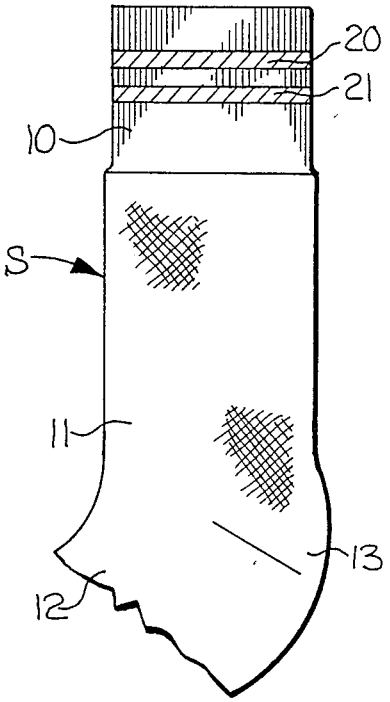
FIG. 2 is a view similar to FIG. 1 but showing a different size sock with two size indicating stripes in the cuff portion.
Figure 3:
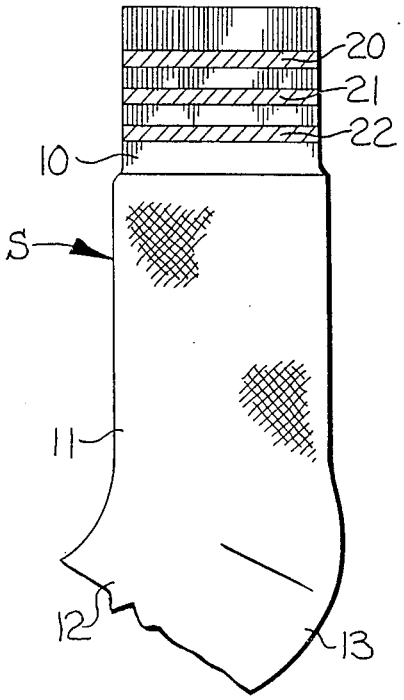
FIG. 3 is a view similar to FIGS. 1 and 2 but showing yet another size of sock with three size indicating stripes in the cuff portion.

A selected number of size indicating stripes 20, 21, 22 extend completely around a particular location in one portion of the sock, illustrated as the cuff 10 in FIGS. 1–3. The size indicating stripes 20, 21 and 22 are knit in a plurality of the circular courses with a yarn contrasting in color with the particular color of yarn knit throughout the remainder of the cuff 10. The number of size indicating stripes of contrasting color yarn is selected to indicate the particular size of the sock in which the size indicating stripes are knit so that the size of the sock is easily recognizable by the number of size indicating stripes 20, 21, 22 in the cuff 10 of the sock. For example, one size indicating stripe 20, as illustrated in FIG. 1, can be utilized as the size indicating indicia for socks which are knit to fit people requiring sock sizes 10–13. Two size indicating stripes, as indicated at 20 and 21 in FIG. 2, can be utilized to indicate medium size socks which are knit to fit wearers requiring sock sizes 9–11. Three size indicating stripes 20, 21, 22, as illustrated in FIG. 3, can be utilized to designate smaller size socks which are knit to fit wearers requiring sock sizes 7–9.

It is preferred that the size indicating stripes 20, 21, 22 are each knit in four adjacent courses to form the corresponding stripe. Also, when two or more size indicating stripes are formed, it is preferred that the distance between adjacent of the size indicating stripes is the same as the width of the stripes, that is, four adjacent courses.

The socks of the present invention are provided with a selected number of size indicating stripes in the cuff portion with the size indicating stripes being of a contrasting color yarn with the color of yarn being knit in the surrounding area of the sock. The number of size selecting stripes is selected to indicate the size of the sock in which the size indicating stripes are knit so that the size of a particular sock is easily recognizable by the number of size indicating stripes knit in the cuff of the sock.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. Socks each including integrally knit cuff, leg and foot portions, said socks being knit in a variety of sizes and substantially throughout with circular courses of a particular color of yarn, each of said socks including one or more size indicating stripes extending completely around and in a particular location in one of said sock portions, said size indicating stripes being knit in a plurality of the circular courses and of a yarn contrasting in color with said particular color of yarn, and wherein the number of said size indicating stripes of contrasting color yarn constitutes means for indicating and selecting to a prospective customer at the point of sale the size of the particular sock in which said size indicating stripes are knit so that the size of the particular sock is easily recognizable by the number of said size indicating stripes knit in the particular location in one of said sock portions.

2. Socks according to claim 1 wherein said size indicating stripes are located in said cuff portion.

3. Socks according to claim 2 wherein said size indicating stripes are each knit in four adjacent courses.

4. Socks according to claim 3 including at least two of said size indicating stripes, and wherein the distance between adjacent of said size indicating stripes is the same as the width of said stripes.

5. Socks according to claim 3 wherein a particular size of sock includes one of said size indicating stripes, a sock of a different size includes two of said size indicating stripes, and a sock of another different size includes three of said size indicating stripes.

* * * * *